US007485031B1

(12) United States Patent
Stubbs

(10) Patent No.: US 7,485,031 B1
(45) Date of Patent: Feb. 3, 2009

(54) ANGLE SANDER

(75) Inventor: Preston Stubbs, Spring Valley, CA (US)

(73) Assignee: Drywall Ideas, LLC, Clive, IA (US)

( * ) Notice: Subject to any disclaimer, the term of this patent is extended or adjusted under 35 U.S.C. 154(b) by 64 days.

(21) Appl. No.: 11/190,586

(22) Filed: Jul. 27, 2005

(51) Int. Cl.
*B24D 15/00* (2006.01)

(52) U.S. Cl. ..... 451/523; 451/524

(58) Field of Classification Search ..... 451/354, 451/495, 523–525, 512
See application file for complete search history.

(56) References Cited

U.S. PATENT DOCUMENTS

| | | | | | |
|---|---|---|---|---|---|
| 1,782,577 | A | * | 11/1930 | Maris | 451/515 |
| 2,608,853 | A | * | 9/1952 | Shrepper | 15/235.7 |
| 2,616,285 | A | * | 11/1952 | Shields | 15/235.7 |
| 2,689,436 | A | * | 9/1954 | Wagner | 451/356 |
| 2,711,059 | A | | 6/1955 | Ames | |
| 2,817,931 | A | | 12/1957 | Houser | |
| 3,192,678 | A | * | 7/1965 | Buratti | 451/522 |
| 3,279,130 | A | | 10/1966 | Nelson | |
| 3,373,458 | A | * | 3/1968 | Haivala | 15/235.7 |
| 3,713,744 | A | * | 1/1973 | Sims | 401/9 |
| 3,842,549 | A | | 10/1974 | Johnston | |
| 4,249,349 | A | * | 2/1981 | Rueb | 451/524 |
| 4,619,013 | A | * | 10/1986 | Yon | 15/235.8 |
| 4,757,572 | A | * | 7/1988 | Yon | 15/235.7 |
| 4,774,789 | A | | 10/1988 | Amalfi | |
| 4,825,597 | A | | 5/1989 | Matechuk | |
| 4,887,396 | A | * | 12/1989 | Lukianoff | 451/523 |
| 5,313,746 | A | * | 5/1994 | Zarriello | 451/522 |
| 5,337,523 | A | * | 8/1994 | Walsh | 451/502 |
| 5,345,724 | A | | 9/1994 | Ng, Jr. | |
| D373,715 | S | | 9/1996 | Finik | |
| 5,605,500 | A | * | 2/1997 | Matechuk | 451/456 |
| 5,690,547 | A | * | 11/1997 | Holland et al. | 451/524 |
| 5,718,622 | A | | 2/1998 | Jones | |
| 5,807,161 | A | * | 9/1998 | Manor et al. | 451/442 |
| 5,895,316 | A | | 4/1999 | Williams | |
| 5,947,803 | A | * | 9/1999 | Gruner | 451/354 |
| 5,993,306 | A | * | 11/1999 | McCoy et al. | 451/523 |
| 6,267,658 | B1 | * | 7/2001 | Ali et al. | 451/523 |
| 6,325,708 | B1 | * | 12/2001 | Miles | 451/354 |
| 6,439,988 | B1 | * | 8/2002 | Long et al. | 451/495 |
| D497,092 | S | | 10/2004 | McCarthy | |
| 6,960,125 | B2 | * | 11/2005 | Mick | 451/525 |
| 7,264,541 | B1 | * | 9/2007 | Ray et al. | 451/344 |
| 2002/0132573 | A1 | * | 9/2002 | Rich et al. | 451/539 |
| 2003/0224708 | A1 | * | 12/2003 | Koenig, Jr. | 451/461 |

* cited by examiner

*Primary Examiner*—Maurina Rachuba
(74) *Attorney, Agent, or Firm*—McKee, Voorhees & Sease, P.L.C.

(57) ABSTRACT

A dry wall angle sander for simultaneously sanding both sides of an inside corner without grooving generally comprises a body including a pad of compressible, flexible, and resilient material mounted on a carrier and a handle for gripping by a user. The pad has outward facing dihedral sanding surfaces having an outer dihedral angle of two hundred seventy degrees. The sanding surfaces meet at a juncture defining the longitudinal direction. The length of each sanding surface diminishes proximate the maxim width so that sanding is less aggressive there. Preferably, also, the flexibility of each sanding surface increases proximate its maximum width so that the sanding is less aggressive there.

19 Claims, 2 Drawing Sheets

FIG. 2
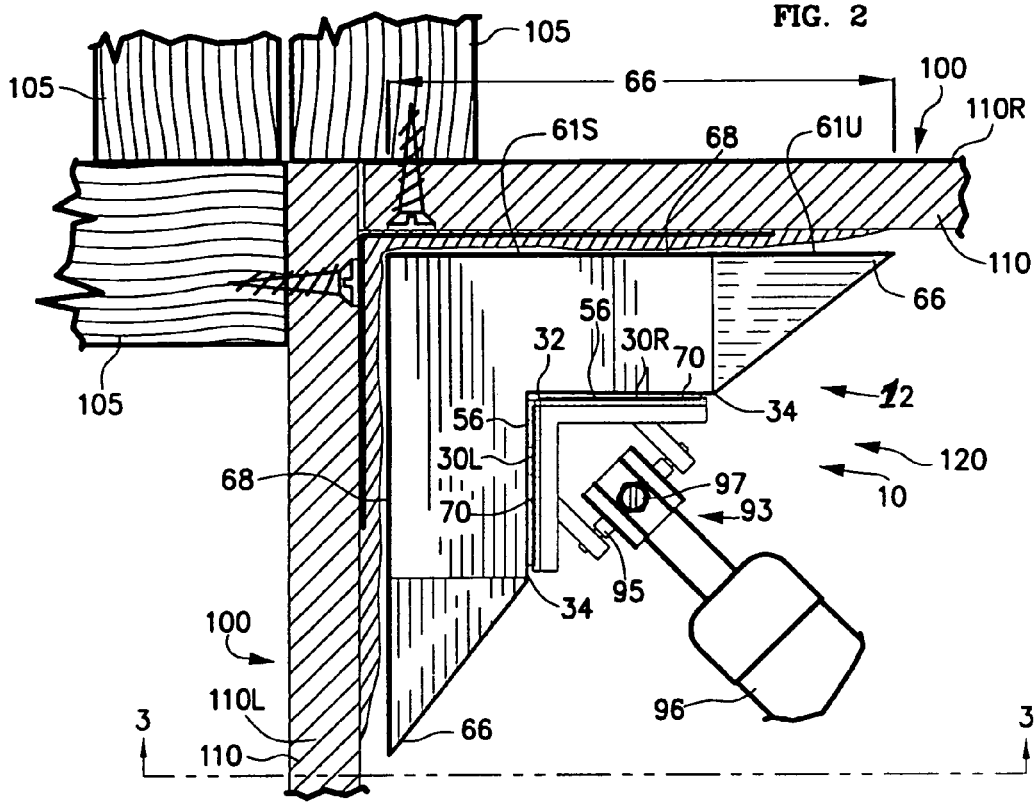
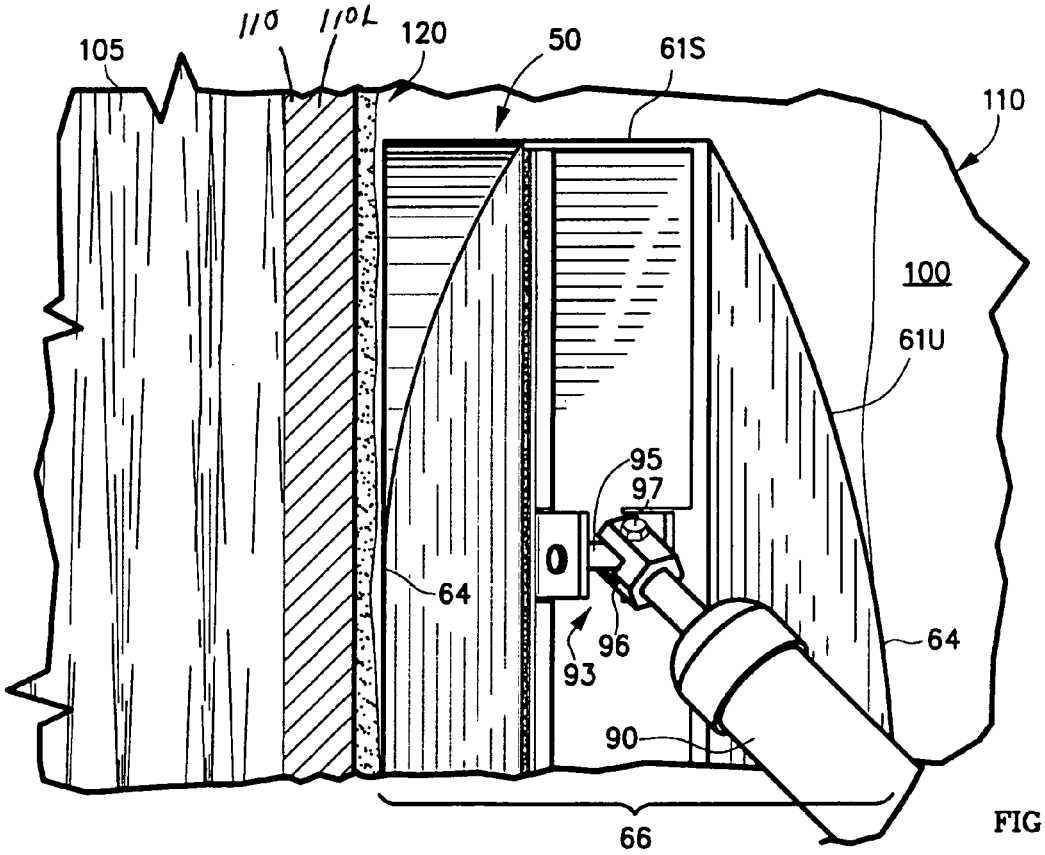
FIG. 3

ANGLE SANDER

FIELD OF THE INVENTION

This invention relates in general to angle sanders and more specifically to a dry wall angle sander for simultaneously sanding, both sides of an inside corner without grooving.

BACKGROUND OF THE INVENTION

Sheet rock or drywall panels are commonly used on walls and ceilings of homes. In the process of installing sheet rock or drywall, sheets of the material are usually secured to a stud wall. Thereafter the joints and seams existing between the respective sheets are taped. The tape is then covered with a drywall compound, usually a hardening putty. Thereafter, these puttied seams or joints are sanded which results in a smooth finish being formed along the seam and joint areas. This readies the surface for painting.

However, sanding the inside corner areas is particularly problematic. Sanding the corners with a conventional block sander requires much time and effort. More importantly, it is difficult to sand into the corner without gouging or digging grooves into one or both side walls.

Several sanders have been proposed specifically for the sanding of inside drywall corners. However, most proposed sanders are directed to speeding the sanding by sanding both walls at one time and do not address the problem of grooving.

U.S. Pat. No. 6,325,708 does address the grooving problem and describes a corner sander having outer sanding walls that are separated by less than a ninety degree angle. In this manner, a wall sanded adjacent the corner without grooving the adjacent wall. However, the grooving is avoided at the expense of time, as only one wall at a time is sanded.

Therefore, there has been and continues to be a need for a drywall inside corner sander that is particularly designed to sand and finish both walls adjacent a drywall corner in an effective and efficient manner without cutting or forming grooves in the drywall compound in and around the drywall corner.

SUMMARY OF THE INVENTION

The invention is a angle sander for sanding an inside corner of two meeting wall surfaces such as drywall panels and it generally comprises a body including a pad of compressible, flexible, and resilient material mounted on a carrier and a handle for gripping by a user.

The pad has outward facing dihedral sanding surfaces having an outer dihedral angle of two hundred seventy degrees. The sanding surfaces meet at a juncture defining the longitudinal direction. The length of each sanding surface diminishes proximate the maxim width so that sanding is less aggressive there.

Preferably, also, the flexibility of each sanding surface increases proximate its maximum width so that the sanding is less aggressive there. The flexibility of each sanding surface is increased by making the width of each sanding surface greater than the width of its underlying support surface such that an unsupported area of each sanding surface extends laterally outward past the distal edge of its support surface. The flexibility of each sanding surface is also increased by diminishing, the thickness of the pad proximate the maximum width of each sanding surface.

The features and advantages of the invention will be readily understood when the detailed description thereof is read in conjunction with the accompanying drawings wherein like reference numerals refer to like parts throughout.

BRIEF DESCRIPTION OF THE DRAWINGS

FIG. 2 is an end view of the angle sander of FIG. 1 shown sanding the inside corner of drywall in cross section.

FIG. 3 is a side view of one end of the angle sander taken on line 3-3 of FIG. 2; the other end of the sander being a mirror image.

DETAILED DESCRIPTION OF THE INVENTION

Figure 1:
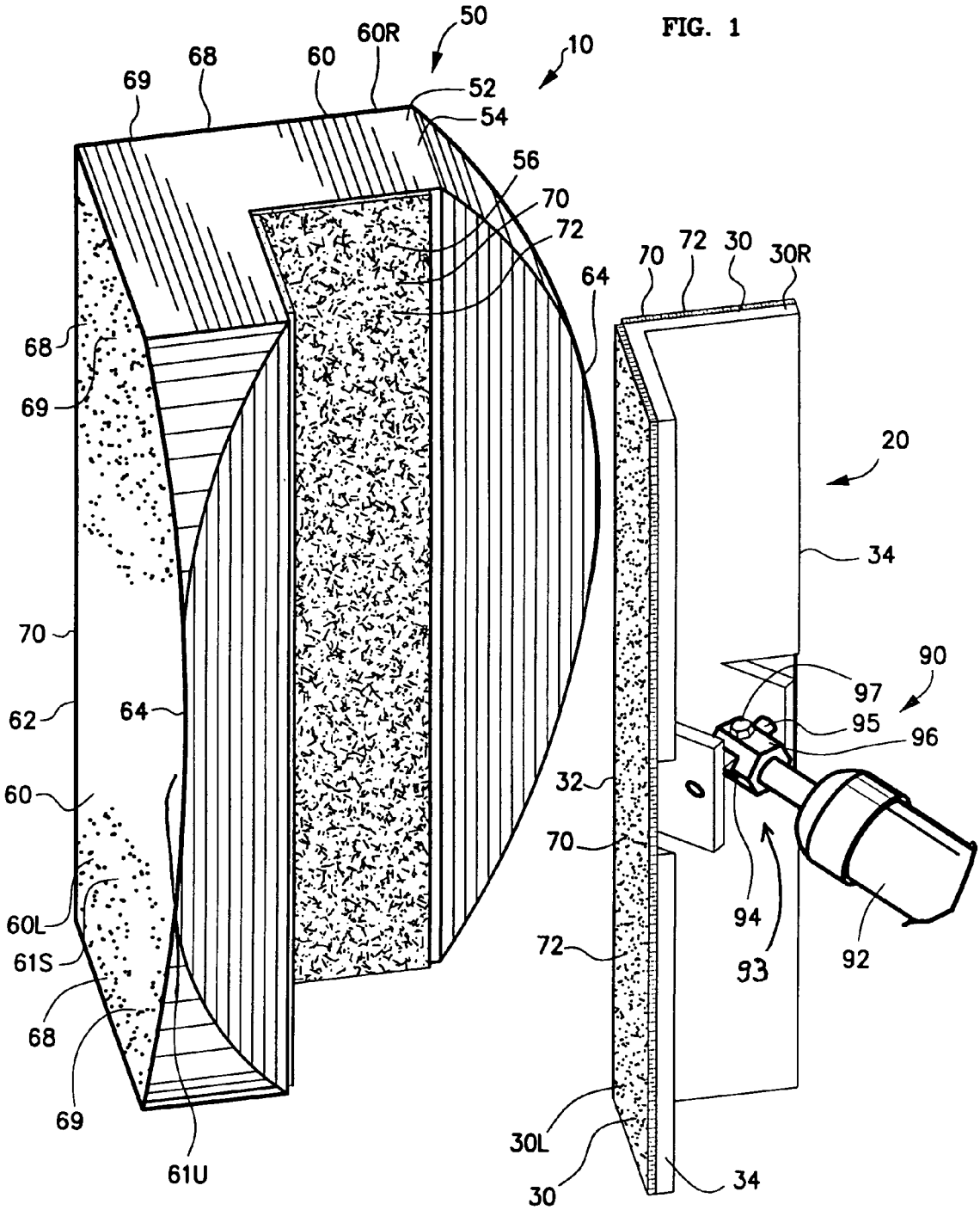
FIG. 1 is an exploded perspective view of the angle sander of the invention.

With reference now to the drawings, FIG. 1 is an exploded perspective view of an exemplary embodiment of the angle sander 10 of the invention; FIG. 2 is an end view of the angle sander 10 of FIG. 1 shown sanding the inside corner 120 of drywall panels 110; one panel 110L shown in cross section; and FIG. 3 is a side view of one end of angle sander 10 taken on line 3-3 of FIG. 2; the other end of sander 10 being a mirror image.

Typical wall 100 includes drywall panels 110 mounted, such as by nails, onto wall studs 105. Drywall panels 110, such as left panel 110L and right panel 110R, meet to define an inside corner 120. Drywall panels 110 both may be wall panels or may be a wall and a ceiling panel.

Angle sander 10, for simultaneously sanding both sides panels 110L, 110R of inside corner 120 without grooving, generally comprises a sanding body 12 and handle means 90 connected to sanding body 12 for manipulating sander 10 by a user. Sanding body 12 generally comprises a carrier 20 and a sanding pad 50 mounted on carrier 20. Sander 10 is symmetrical about a plane bisecting corner 120.

Sanding pad 50 substantially comprises a core 52 of compressible, flexible, and resilient material 53, such as of foam 54 or a rubber-like material. Core 52 has outward facing dihedral sanding surfaces 60, such as left and right sanding surfaces 60L, 60R, having an outer dihedral angle of 270 degrees or slightly less. Sanding surfaces 60 function as sanding surfaces. Sanding surfaces 60 may be coated with a layer of abrasive material 68, such as sandpaper 69, shown, or abrasive material 68 may be incorporated into core material 53.

Sanding surfaces 60 meet at juncture 62. Juncture 62 defines the longitudinal direction of sander 10. Each sanding surface 60L, 60R has a length in the longitudinal direction and has a width terminating at a lateral distal edge 64. As best seen in FIG. 3, sanding surface 60 is not rectangular. Distal edge 64 assumes a curved path in side view such that the local length of sanding surface 60 diminishes proximate the maximum width 66. In this manner, less sanding tends to occur near maximum width 66 than toward juncture 62 where the length is longer. Consequently, the sanding near the maximum width is feathered and less likely to form grooves.

Carrier 20 includes a pair of rigid outward facing dihedral support surfaces 30, such as left and right surfaces 30L, 30R. Preferably support surfaces 30 have an outer dihedral angle of 270 degrees or more. Support surfaces 30 meet at a longitudinal juncture 32. Each support surface 30 has a length and has a width terminating at a distal edge 34. Typically, support surfaces 30 are rectangular, each having a length approximately the maximum length of sanding surface 60. Carrier 20 may be made of any suitable material such as aluminum or strong plastic.

Pad 50 has a thickness at right angles to sanding surfaces 60. In the exemplary embodiment, the thickness of pad 50 is substantially uniform over the area, supported area 61S, supported by support surfaces 30 such that sanding under this portion of sander 10 is relatively uniform.

Sanding pad 50 is mounted on carrier 20. Preferably, sanding pad 50 and carrier 20 include attaching means 70 for selectively detachably attaching pad 50 to carrier 20 such that pad 50 is replaceable when sanding surfaces 60 are no longer effective for sanding. To this end, support surfaces 30 of carrier 20 and attaching surface 56 of sanding pad 50 are provided with a cooperating hook and loop fastener material 72. Alternatively, sandpaper 69 may be separately replaceable or the entire sanding body disposed of when the abrasive material is no longer effective.

Angle sander 10 includes additional features to prevent grooving by increasing the flexibility of sanding pad 50 near its maximum width. Increased flexibility is provided in two matters, singly or combined.

First, the width of each sanding surface 60L, 60R is greater than the width of its underlying support surface 30L, 30R such that an unsupported area 61U of sanding surface 60 extends laterally outward past distal edge 34 of support surfaces 30L, 30R. This unsupported area 61U is more flexible than the supported area 61S and applies a lesser pressure to the sandpaper such that sanding is unsupported area 61U is less aggressive so as to be less likely to groove drywall 110.

Second, unsupported area 61U is made even more flexible by reducing the thickness of foam 54 proximate its maximum width. In the exemplary embodiment, the thickness of core foam 54 that is unsupported is reduced linearly laterally outward.

The angle of outer dihedral angle may be 270 degrees or slightly less to sand inside corners of approximately ninety degrees. With adequate reduction of the sanding surface and sanding pressure near the outer width, sander 10 can accommodate a small range of inside corner angles without grooving.

Handle means 90, such as elongate, telescoping tubular handle 92, is connected to sanding body 12 by suitable means, such as a universal joint 93. Carrier 20 includes a shackle 94 through which a transverse pivot pin 95 is journaled. Likewise, handle 92 includes a clevis 96 supporting a pivot pin 97 pivotally journaled in a bore of transverse pivot pin 95. Handle 92 enables the sheet rock finisher to reach elevated heights when using drywall sander 10.

From the foregoing description, it is seen that the present invention provides an extremely simple, efficient, and reliable dry wall angle sander for simultaneously sanding both sides of an inside corner without grooving.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. An angle sander for sanding an inside corner of two meeting wall surfaces comprising:

a body including:

an L-shaped pad of compressible, flexible, and resilient material having outward facing sanding surfaces meeting at a 90° juncture;

each sanding surface having a top, a bottom, and a side edge; the side edge of each sanding surface being curved along its length whereby each sanding surface has a reduced width adjacent the top and bottom and an increased width between the top and bottom.

2. The angle sander of claim 1 wherein:

the body further includes:

an L-shaped carrier comprising:

a pair of rigid outward facing support surfaces meeting at a 90° juncture;

each support surface having a length and having a width terminating at a distal edge; and wherein:

the pad is mounted on said carrier;

the pad has a thickness at right angles to the sanding surfaces; and the flexibility of each sanding surface increases proximate its maximum width.

3. The angle sander of claim 2 wherein:

the thickness of the pad diminishes proximate the maximum width of each sanding surface.

4. The angle sander of claim 1 further including:

handle means attached to the body for grasping by a user.

5. An angle sander for sanding an inside corner of two meeting wall surfaces comprising:

a body including:

an L-shaped carrier comprising:

a pair of rigid outward facing support surfaces;

the support surfaces meeting at a vertical juncture;

each support surface having a width terminating at a distal edge and having a length; and an L-shaped pad of compressible, flexible, and resilient material having outward facing sanding surfaces having an outer angle of approximately two hundred seventy degrees;

the surfaces meeting at a vertical juncture;

each surface having top and bottom edges defining a length and having a width between the juncture and an outer side edge;

the thickness of said pad diminishing along the outer side edge between the top and bottom edges of each sanding surface.

6. The angle sander of claim 5 wherein:

said pad is mounted on said carrier such that each said sanding surface overlies one of the support surface; the width of each sanding surface being greater than the width of its one support surface such that an unsupported area of each sanding surface extends laterally outward past the distal edge of its support surface.

7. The angle sander of claim 5 further including:

handle means attached to said body for grasping by a user.

8. An improved corner sander, comprising:

a carrier having angularly disposed support surfaces;

an L-shaped sanding pad having angularly disposed left and right inner attaching surfaces for mounting the pad to the carrier and angularly disposed left and right outer sanding surfaces;

the left inner and outer surfaces being parallel, and the right inner and outer surfaces being parallel;

the sanding pad having opposite left and right edges extending between the left and right inner and outer surfaces, respectively; and the edges being tapered inwardly at an acute angle from the outer surface to the inner surface.

9. The corner sander of claim 8 wherein the pad has opposite top and bottom ends, and the edges being curved between the ends about an axis extending perpendicular to the sanding surfaces.

10. The corner sander of claim 8 wherein the carrier has opposite side edges, and the pad edges extend beyond the carrier edges.

11. The corner sander of claim 9 wherein the carrier has opposite side edges, and the pad edges extend beyond the carrier edges.

12. The corner sander of claim 8 further comprising a handle pivotally attached to the carrier.

13. An improved corner sander, comprising:

a carrier having angularly disposed support surfaces;

a sanding pad having angularly disposed inner attaching surfaces for mounting the pad to the carrier and angularly disposed outer sanding surfaces;

the sanding pad having opposite edges extending between the inner surfaces and outer surfaces;

the pad having opposite top and bottom ends; and the pad edges being curved between the ends along a radius having a horizontal axis.

14. The corner sander of claim 13 wherein the pad edges are tapered.

15. The corner sander of claim 14 wherein the carrier has opposite side edges, and the pad edges extend beyond the carrier edges.

16. The corner sander of claim 13 wherein the carrier has opposite side edges, and the pad edges extend beyond the carrier edges.

17. The corner sander of claim 13 further comprising a handle pivotally attached to the carrier.

18. The corner sander of claim 8 wherein the carrier is L-shaped.

19. The corner sander of claim 13 wherein the carrier and the pad have complimentary L-shapes.

* * * * *